US005160172A

United States Patent [19]

Gariepy

[11] Patent Number: 5,160,172

[45] Date of Patent: Nov. 3, 1992

[54] THREADED LATCH RING TUBULAR CONNECTOR

[75] Inventor: James A. Gariepy, Cypress, Tex.

[73] Assignee: ABB Vetco Gray Inc., Houston, Tex.

[21] Appl. No.: 821,121

[22] Filed: Jan. 14, 1992

Related U.S. Application Data

[63] Continuation of Ser. No. 629,429, Dec. 18, 1990, abandoned.

[51] Int. Cl.[5] ..... F16L 15/00

[52] U.S. Cl. ..... 285/18; 285/141; 285/34; 285/334; 285/922; 285/355; 285/392

[58] Field of Search ..... 285/18, 141, 142, 143, 285/92, 334, 355, 392, 333, 330, 34

[56] References Cited

U.S. PATENT DOCUMENTS

| | | | |
|---|---|---|---|
| 2,296,198 | 9/1942 | Boynton | 285/922 |
| 2,542,679 | 3/1950 | Kemnitz | 285/334 |
| 2,849,245 | 8/1958 | Baker | 285/141 |
| 3,345,084 | 2/1965 | Hanes et al. | 285/34 |
| 3,721,292 | 3/1973 | Ahlstone | 285/18 |
| 3,800,869 | 4/1974 | Herd et al. . | |
| 3,971,576 | 7/1976 | Herd et al. . | |
| 4,310,048 | 1/1982 | Mott . | |
| 4,607,865 | 8/1986 | Hughes | 285/141 |
| 4,641,708 | 2/1987 | Wightman | 285/141 |
| 4,655,979 | 5/1987 | Boehm, Jr. . | |
| 4,773,477 | 9/1988 | Putch | 285/141 |
| 4,844,510 | 7/1989 | Theiss et al. . | |
| 4,989,902 | 2/1991 | Putch | 285/18 |

*Primary Examiner*—Randolph A. Reese
*Assistant Examiner*—Timothy Aberle
*Attorney, Agent, or Firm*—James E. Bradley

[57] ABSTRACT

A tubular connector joint has a pin member on one of the tubular members and a box member on the other of the tubular members. External pin threads are formed on the exterior of the pin member. Internal box threads have the same pitch as the pin threads. A latch ring locates between the pin threads and box threads. The latch ring contracts and has threads on its inner and outer diameter that mate with the threads of the two tubular members. A drive key causes the latch ring to rotate with the pin member. The latch ring contracts when the upper tubular member stabs into the lower tubular member. A short amount of rotation then causes the drive ring to engage the threads of the lower tubular member.

2 Claims, 3 Drawing Sheets

THREADED LATCH RING TUBULAR CONNECTOR

This application is a continuation of application Ser. No. 07/629,429, filed Dec. 18, 1990 now abandoned.

BACKGROUND OF THE INVENTION

1. Field of the invention

This invention relates in general to connectors for tubular members, particularly for oil field use, and particularly for a connector that utilizes a latch ring.

2. Description of the Prior Art

Certain operations in subsea well drilling require an upper tubular connector to be lowered remotely into engagement with a lower tubular member located subsea. This may occur in tieback and mudline operations, for example. In these types of operations, the operator wishes to be able to releasably secure the upper tubular member into the lower tubular member without extensive rotation. The operator wishes to be able to release the upper tubular member from the lower tubular member by reverse rotation.

In one type of prior art connector, the upper tubular member has a pin on its upper end that stabs into a receptacle or box on the lower tubular member. The upper tubular member carries a latch ring. The latch ring will contract during the stabbing movement. Subsequent rotation will secure the members together.

There are various types of latch rings. One utilizes a latch ring with a thread on the outer diameter and square shoulders on the inner diameter. While workable, this necessitates a latch ring with thick wall sections to accommodate areas where the outer diameter thread is not backed up by a shoulder. A thick latch ring reduces the diameter of the bore of the connector.

SUMMARY OF THE INVENTION

The tubing connector of this invention utilizes a latch ring carried on the pin or upper tubular member. The pin has exterior threads. The box member has interior threads. The pitch of the interior and exterior threads is the same.

The latch ring is mounted to the pin member so that it will contract when stabbed into the box. A drive key causes the latch member to rotate with the pin member. The latch has internal threads that are the same configuration as, and mate with the pin threads. The latch has external threads that are the same configuration as and mate with the box threads.

DETAILED DESCRIPTION OF THE INVENTION

Figure 1:
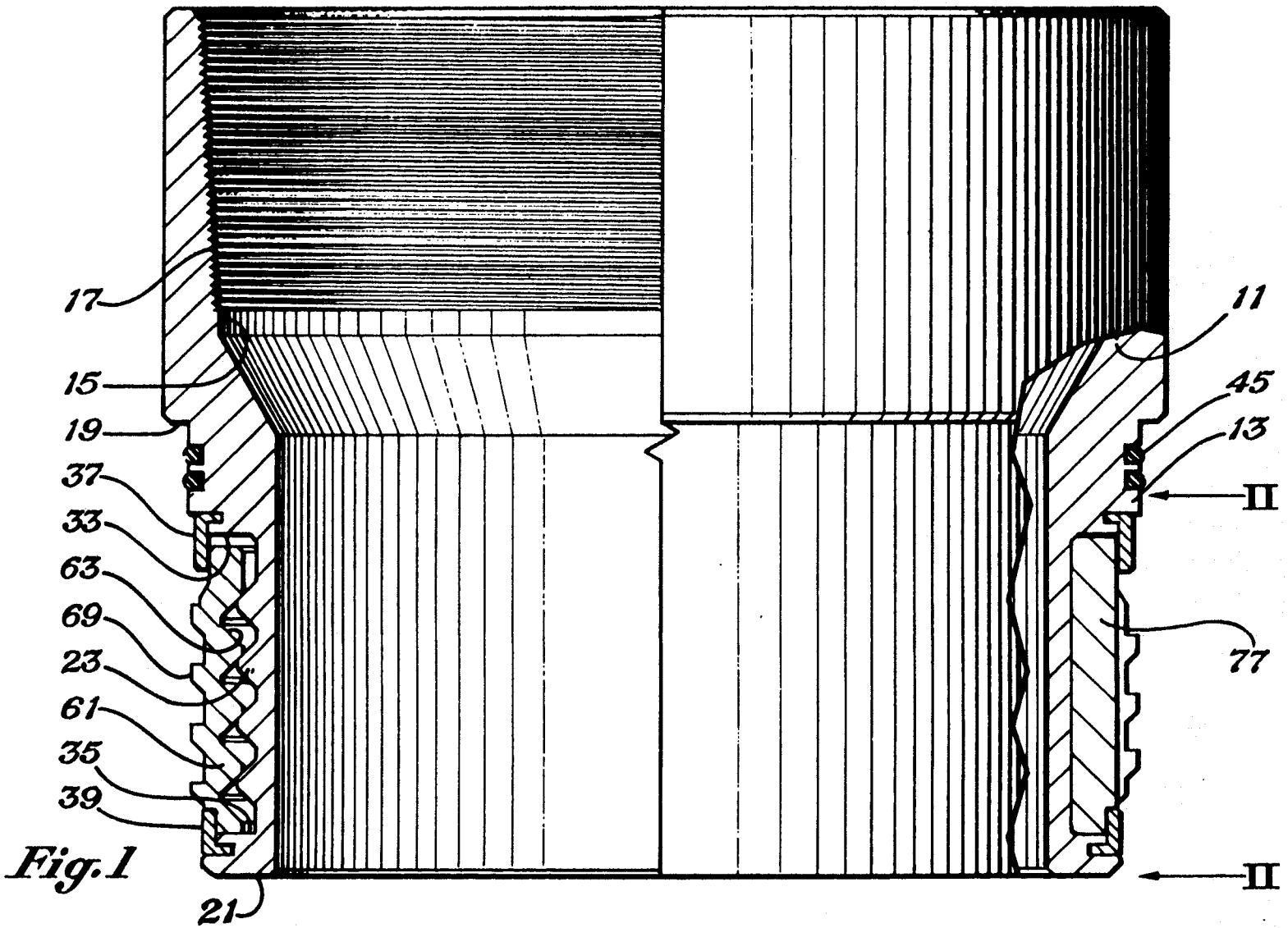
FIG. 1 is a partially sectioned view of a pin member having threads and a latch ring constructed in accordance with this invention.
Figure 3:
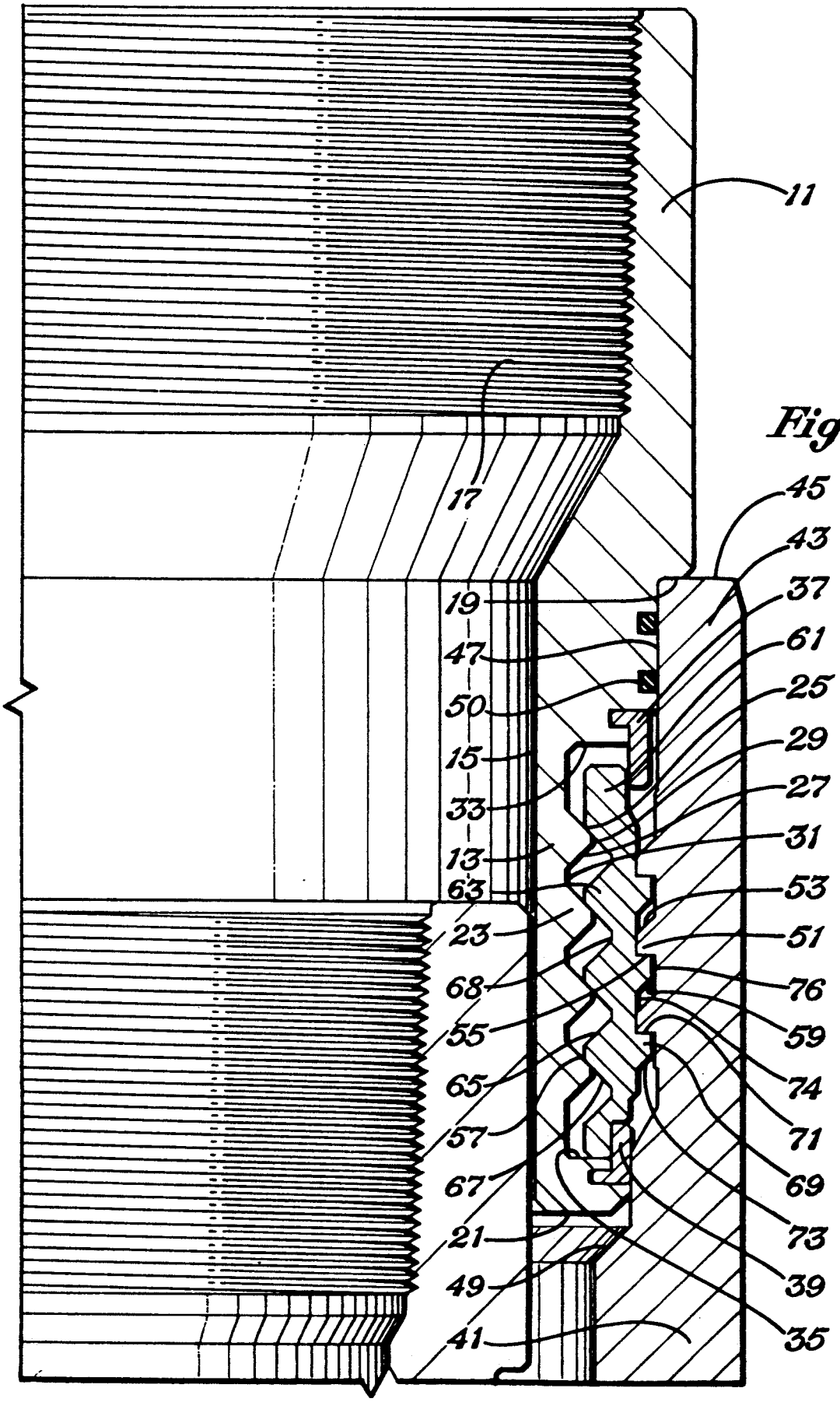
FIG. 3 is a partial vertical side view of the pin member of FIG. 1, shown stabbed into a box member constructed in accordance with this invention.

Referring to FIGS. 1 and 3, and in particular to FIG. 3, upper tubular member 11 will have a pin 13 on its lower end. Pin 13 is an integral lower portion of the upper tubular member 11. An axial bore 15 extends through the upper tubular member 11. Internal threads

17 locate on the end of the upper tubular member 11 for connecting to a string of casing (not shown). The casing will extend to a drilling vessel (not shown).

Upper tubular member 11 has an exterior, downward facing load bearing shoulder 19. A nose 21 locates at the lower end of pin 13 below the load bearing shoulder 19. A set of pin threads 23 are formed between the nose 21 and the load bearing shoulder 19. Pin threads 23 are exterior and single start, comprising a single helical threadform.

Each pin thread 23 has an upper flank 25 and a lower flank 27. Upper flank 25 is inclined, facing upward and outward. Lower flank 27 is inclined also, at the same degree of inclination relative to the longitudinal axis of bore 15. Lower flank 27 faces downward and outward. A cylindrical crest 29 joins the upper flank 25 with the lower flank 27. A root 31 locates between each of the pin threads 23. Root 31 is also cylindrical and extends axially about the same distance as the axial extent of crest 29.

Pin 13 has an upper retaining shoulder 33 located above the pin threads 23. Upper shoulder 33 faces downward and is perpendicular to the axis of bore 15. Pin 13 also has a lower retaining shoulder 35 a short distance above nose 21. Lower shoulder 35 is also perpendicular to the axis of bore 15, but it faces upward.

An upper retaining ring 37 secures within a groove at the upper shoulder 33. Upper retaining ring 37 depends downward a short distance. A lower retaining ring 39 secures within a groove at the lower shoulder 35. Lower retaining ring 39 extends upward a short distance above the lower shoulder 35.

Upper tubular member 11 secures to a lower tubular member 41. Lower tubular member 41 has a box 43 for receiving the pin 13. Box 43 has a counter bore 47 with a rim 45 on its upper end. A lower internal shoulder 49 locates at the lower end of counter bore 47. Counter bore 47 will closely receive the pin 13 at a point directly below the pin load bearing shoulder 19. Seals 50 located on the exterior of pin 13 below the load bearing shoulder 19 will seal against the upper portion of the box counter bore 47.

Box 43 has a set of box threads 51 located in the interior of lower tubular member 41. Box threads 51 are single start, comprising a single helical threadform. Each box thread 51 has an upper flank 53 that is inclined relative to the axis of lower tubular 41. Upper flank 53 faces upward and inward. Each box thread 51 has a lower flank 55. Lower flank 55 is perpendicular to the axis of lower tubular member 41. A crest 57 joins the upper flank 53 with the lower flank 55 of each of the box threads 51. Crest 57 is cylindrical and extends axially about the same distance as the crest 29 of the pin threads 23. A root 59 locates between each of the box threads 51. Root 59 is also cylindrical. Root 59 extends axially about twice the length as the crest 57.

The pitch of the pin threads 23 is the same as the pitch of the box threads 51. Consequently, the distance between crests 29 of pin threads 23 is the same distance as between the crests 57 of the box threads 51. The radial extent from root 59 to crest 57 of the box threads 51 is slightly less than the radial extent from root 31 to crest 29 of the pin threads 23.

Both the pin threads 23 and the box threads 51 are formed in the same direction. This direction is preferably right hand when viewed above. Also, the load bearing shoulder 19 is positioned so that when load bearing shoulder 19 engages rim 45, each pin crest 29 will be located directly across from one of the box roots 59. A radial line extending through each pin crest 29 would also pass through one of the roots 59.

Pin 13 carries a latch ring 61. Latch ring 61 is a contractible, metal ring. Latch ring 61 has an axial length that is significantly less than the axial distance between the upper and lower shoulders 33, 35. Latch ring 61 has a set of internal threads 63 located in its interior. Internal threads 63 have the same shape and size as the pin threads 23. Internal threads 63 will be in contact with the pin threads 23 at all times. Each internal thread 63 has an upper flank 65 that inclines the same inclination as each lower flank 27 of each pin thread 23. Each internal thread 63 has a lower flank 67 that inclines downward and outward at the same inclination as each upper flank 25 of each pin thread 23. A root 68 locates between each of the threads 63.

Latch ring 61 also has a set of external threads 69. External threads 69 have the same configuration and size as the box threads 51. Each external thread 69 has an upper flank 71 and a lower flank 73. Each upper flank 71 is perpendicular to the axis of the lower tubular member 41. Each lower flank 73 faces downward and outward and inclines at the same inclination as each upper flank 53 of the box threads 51. A root 74 separates each of the external threads 69. A crest 76 separates each upper flank 71 from a lower flank 73. Each root 68 of the internal threads 63 is located radially inward from a root 74 of the external threads 69.

Figure 2:
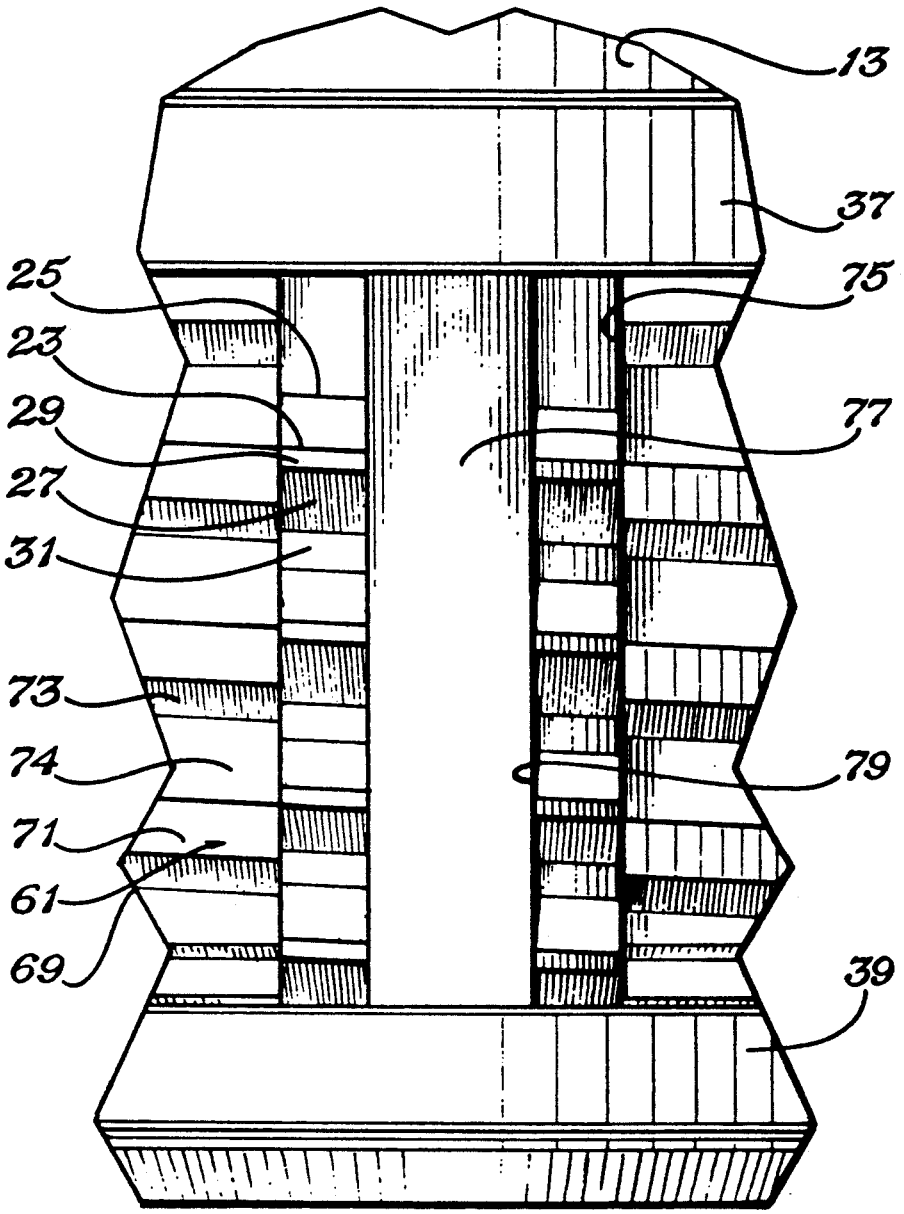
FIG. 2 is a side view of a portion of the pin member of FIG. 1, shown from the view II—II of FIG. 1.

Referring to FIG. 2, latch ring 61 is contractible as a result of a split 75 formed in it. The outer diameter of latch ring 61 is selected to cause it to resiliently spring outward to the position shown in FIG. 3. In the position shown in FIG. 3, the exterior of latch ring 61 contacts the upper retainer 37 and the lower retainer 39. A clearance will exist between the upper flanks 65 of the latch internal threads 63 and the lower flanks 27 of the pin threads 23.

A key 77, shown in FIGS. 1 and 2, provides drive means for causing the latch ring 61 to rotate in unison with the pin 13. Key 77 is a metal member that locates within a slot 79 in the pin 13 and within the split 75 of latch ring 61. Key 77 extends the full axial distance between pin retainer shoulders 33 and 35. The circumferential width of key 77 is slightly less than the circumferential width of split 75 when latch ring 61 is contracted and considerably less when the latch ring 61 is expanded, as shown in FIG. 2. When latch ring 61 is fully contracted, one side of key 77 will contact one side of the split 75 when the upper tubular 11 member 11 (FIG. 3) rotates. The side contacted by key 77 of split 75 serves as a drive shoulder to cause the latch ring 61 to rotate with the pin 13.

In operation, the upper tubular member 11 will be lowered toward the lower tubular member 41. Latch ring 61 will be in the expanded position shown in FIG. 1. The latch internal threads 63 will be engaging the threads 23, but the roots 68 of the latch internal threads 63 will be spaced radially outward and downward from the box thread crests 29. This results in a significant clearance between the latch upper flanks 65 and the box lower flanks 27. The lower end of the latch ring 61 will be touching the lower shoulder 35, which along with the retaining rings 37, 39 serves as a lower limit of travel for the latch ring 61 on the pin 13. The upper retainer shoulder 35 serves as an upper limit of travel of the latch ring 61 on the pin 13. The retainer shoulders 33, 35 and retaining rings 37, 39 serve as retainers for retaining the latch ring 61, but allowing some axial movement relative to the pin 13.

When the pin 13 stabs into the box 43, the box threads 51 will cause the latch ring 61 to radially contract. The split 75 (FIG. 2) will decrease in circumferential width. The latch external threads 69 will ratchet or slide downward past the box threads 51 until the load bearing shoulder 19 contacts the rim 45. Once landed, and depending upon the particular orientation, the latch external threads 69 will be only partially meshed with the box threads 51. The latch external threads 69 may even be positioned crest 76 to crest 57 initially. The nose 21 of the pin 13 will be spaced above the internal lower shoulder 49.

Then the operator will rotate the upper tubular member 11 to the right less than one full turn. The lower tubular member 41 will not rotate as it will be secured to subsea wellhead structure (not shown). The key 77 causes the latch ring 61 to rotate with the upper tubular member 11. This rotation screws the latch ring 61 further into the box 43. The load bearing shoulder 19 will rotate on the rim 45. The latch ring 61 will move downward relative to the pin 13 and also relative to the box threads 51. The latch ring exterior thread upper flanks 71 will bear against the box thread lower flanks 55. The latch ring interior thread lower flanks 67 will bear against the pin thread upper flanks 25. Only about a quarter of a turn is required for full makeup. The makeup results in the load bearing shoulders 19, 45 more tightly engaging each other.

When fully made up, as shown in FIG. 3, load will transmit through the flanks 67 and 25 and also through the flanks 71 and 55. To release the upper tubular member 11 from the lower tubular member 41, the operator will rotate the upper tubular member 11 in the reverse direction, which is to the left. This procedure unscrews latch ring 61 from the box threads 51.

The invention has significant advantages. Because the pitches of the internal and external latch ring profiles are the same, the connector is directly loaded from the upper tubular body to the lower tubular body. Making the pitches identical allows the latch ring to be a much thinner section than prior art latch rings of the type that utilized backup shoulders. This allows the bore of the connector to be larger.

While the invention has been shown in only one of its forms, it should be apparent to those skilled in the art that it is not so limited, but is susceptible to various changes without departing from the scope of the invention.

I claim:

1. In a tubular connection joint for connecting between two tubular members of a type having a pin member on one of the tubular members, a box member on the other of the tubular members for receiving the pin member, a longitudinal axis, and a split latch ring carried by the pin member for releasably securing the tubular members together, the improvement comprising in combination:

a set of helical pin threads formed on the exterior of the pin member, each of the pin threads having an upper flank facing upward and outward that is a single continuous conical surface;

a set of helical box threads formed in the interior of the box member, each of the box threads having a lower flank that is perpendicular to the axis;

each of the pin threads and the box threads being separated by a root and each having a crest, the distance from crest to crest on the pin threads being the same as the distance from crest to crest on the box threads;

a set of helical external latch threads formed on the exterior of the latch ring for engaging the box threads, the external latch threads each having an upper flank that is perpendicular to the axis for engaging one of the lower flanks of the box threads;

a set of helical internal latch threads formed in the interior of the latch ring for engaging the pin threads, each of the internal latch threads having a lower flank that faces downward and inward and is a single continuous conical surface at the same inclination as the upper flanks of the pin threads for engaging the upper flanks of the pin threads;

each of the internal threads and external latch threads having a crest, the crests of the internal and external latch threads being radially aligned with each other;

upper and lower retainers located above and below the latch ring for carrying the latch ring on the pin member, the upper and lower retainers being spaced axially apart a distance greater than the axial extent of the latch ring to allow selected axial movement of the latch ring relative to the pin member;

an axially extending key slot formed on the exterior of the pin member;

a drive key located in the key slot in engagement with both the latch ring and the pin member for causing the latch ring to rotate with the pin member; and the engagement of the internal latch threads with the pin threads allowing sufficient play for the latch ring to retract when the pin member stabs into the box member, with subsequent rotation of one of the tubular members relative to the other causing the lower flanks of the internal latch threads to slide downward and outward on the upper flanks of the pin threads and causing the upper flanks of the external latch threads to bear tightly against the lower flanks of the box threads, each the conical surfaces of the internal latch threads and the pin member engaging each other when the connection joint is fully made up.

2. In a tubular connection joint for connecting between two tubular members of a type having a pin member on one of the tubular members, a box member on the other of the tubular members for receiving the pin member, a longitudinal axis, and a split latch ring having upper and lower ends and carried by the pin member for releasably securing the tubular members together, the improvement comprising in combination:

a set of helical pin threads formed on the exterior of the pin member, each of the pin threads having an upper flank facing upward and outward that is a single continuous conical surface and a lower flank facing downward and outward;

a set of helical box threads formed in the interior of the box member, each of the box threads having an upper flank facing upward and outward and a lower flank that is perpendicular to the axis;

each of the pin threads and the box threads having a crest, with a root located between the crests;

a set of helical external latch threads formed on the exterior of the latch ring for engaging the box threads, the external latch threads each having an upper flank that is perpendicular to the axis for engaging one of the lower flanks of the box threads and having a lower flank that faces downward and outward and is a single continuous conical surface at the same inclination as the upper flank of the box threads;

a set of helical internal latch threads formed in the interior of the latch ring for engaging the pin threads, each of the internal latch threads having a lower flank that faces downward and inward at the same inclination as the upper flanks of the pin threads for engaging the upper flanks of the pin threads and having an upper flank that faces upward and inward at the same inclination as the lower flanks of the pin threads;

a downward facing upper retainer shoulder located above the upper end of the latch ring for limiting upward travel of the latch ring relative to the pin member;

a downward facing lower retainer shoulder located below the lower end of the latch ring for limiting downward travel of the latch ring relative to the pin member, the upper and lower retainer shoulders being spaced axially apart greater than the distance from the upper end to the lower end of the latch ring to allow selected axial movement of the latch ring relative to the pin member;

an axially extending key slot formed on the exterior of the pin member;

an axially extending drive shoulder located in the interior of the latch ring, positioned to register with the key slot;

a drive key located in the key slot and in engagement with the drive shoulder for causing the latch ring to rotate with the pin member;

a load bearing shoulder formed on the box member;

a load bearing shoulder formed on the pin member above the upper retainer shoulder for engaging the load bearing shoulder on the box member and limiting the extent of movement of the pin member into the box member;

the dimensions of the split of the latch ring allowing the latch ring to retract when the pin member stabs into the box member, with subsequent rotation of the pin member relative to the box member causing the lower flanks of the internal latch threads to slide downward and outward on the upper flanks of the pin threads and causing the upper flanks of the external latch threads to bear tightly against the lower flanks of the box threads; and the pin threads and box threads being axially positioned such that when the load bearing shoulders fully engage each other, each of the crests of the box threads will be located radially outward from one of the roots of the pin threads, each the conical surfaces of the internal latch threads and the pin member engaging each other when the connection joint is fully made up.

* * * * *

UNITED STATES PATENT AND TRADEMARK OFFICE

CERTIFICATE OF CORRECTION

PATENT NO. :5,160,172

DATED :November 3, 1992

INVENTOR(S) :James A. Gariepy

It is certified that error appears in the above-indentified patent and that said Letters Patent is hereby corrected as shown below:

Column 3, line 50, the first occurrence of "11" is deleted.

Signed and Sealed this

Ninth Day of November, 1993

Bruce Lehman

*Attest:*

BRUCE LEHMAN

*Attesting Officer*

*Commissioner of Patents and Trademarks*